US008550676B2

(12) United States Patent
Ohno et al.

(10) Patent No.: US 8,550,676 B2
(45) Date of Patent: Oct. 8, 2013

(54) VEHICLE LIGHT

(75) Inventors: Masafumi Ohno, Tokyo (JP); Ryotaro Owada, Tokyo (JP); Norikatsu Myojin, Tokyo (JP); Mitsuo Yamada, Tokyo (JP); Yasushi Kita, Tokyo (JP); Satoshi Sakai, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 298 days.

(21) Appl. No.: 12/901,485

(22) Filed: Oct. 8, 2010

(65) Prior Publication Data

US 2011/0085343 A1 Apr. 14, 2011

(30) Foreign Application Priority Data

Oct. 8, 2009 (JP) ..... 2009-234436

(51) Int. Cl.
*F21V 11/00* (2006.01)

(52) U.S. Cl.
USPC ..... 362/510; 362/41; 362/507; 362/520; 362/311.02

(58) Field of Classification Search
USPC ..... 362/41, 43–52, 459, 475, 486, 487, 362/488, 507, 508, 509, 510, 520, 521, 538, 362/539, 227, 230, 231, 235, 240, 241, 243, 362/244, 245, 247, 249.02, 310, 311.02, 362/335, 336, 341, 800, 460, 485, 498, 499, 362/506, 514, 525, 528, 540–545, 311.01
See application file for complete search history.

(56) References Cited

U.S. PATENT DOCUMENTS

| | | | | |
|---|---|---|---|---|
| 7,261,448 | B2 * | 8/2007 | Ishida et al. | 362/507 |
| 7,387,417 | B2 | 6/2008 | Sazuka et al. | |
| 2007/0047250 | A1 | 3/2007 | Kinoshita | |
| 2009/0003009 | A1 * | 1/2009 | Tessnow et al. | 362/487 |
| 2009/0135581 | A1 * | 5/2009 | Yano et al. | 362/84 |

FOREIGN PATENT DOCUMENTS

| | | | |
|---|---|---|---|
| JP | 11-273407 | A | 10/1999 |
| JP | 2005-141919 | A | 6/2005 |
| JP | 2007-59162 | A | 3/2007 |
| JP | 2008-78086 | A | 4/2008 |

* cited by examiner

*Primary Examiner* — Evan Dzierzynski
*Assistant Examiner* — Danielle Allen
(74) *Attorney, Agent, or Firm* — Kenealy Vaidya LLP

(57) ABSTRACT

A vehicle light can include a light emitting diode (LED) serving as a light source and an optical system for controlling a light distribution pattern of the light beams from the LED light source utilizing a light guide (such as a lens body having an inner reflecting surface). The vehicle light can project illumination light with a low beam light distribution pattern. The vehicle light can include an LED light source and a lens body serving as a light guide. The lens body can include a light incident surface, a reflecting surface, and a light exiting surface. The LED light source can have a rearmost end light emitting point from which light beams are emitted to form a bright-dark boundary line. Among the light beams, perpendicularly incident light beams not subjected to refraction can be projected toward the bright-dark boundary line while obliquely incident light beams that are subjected to refraction can be corrected to be directed in a lower angular direction than the bright-dark boundary line and to be mixed with the other light beams, thereby preventing color shading of illumination light from the vehicle light.

11 Claims, 11 Drawing Sheets

Fig. 6

| | Inventive Vehicle Light | | | | | Comparative Headlamp | | | | |
|---|---|---|---|---|---|---|---|---|---|---|
| | x | y | Tc(K) | Intensity (Cd) | Intensity (%) | x | y | Tc(K) | Intensity (Cd) | Intensity (%) |
| L0 (0 degrees *) | 0.3201 | 0.3253 | 7611 | 22767.8 | 77.3 | 0.3428 | 0.3428 | 5137 | 17346.0 | 100.0 |
| L4 (5 degrees *) | 0.3203 | 0.3259 | 7583 | 29458.2 | 100.0 | 0.3566 | 0.3601 | 4622 | 16275.0 | 93.8 |
| L2 (10 degrees *) | 0.3232 | 0.3317 | 7256 | 19592.8 | 66.5 | 0.3586 | 0.3631 | 4569 | 6625.5 | 38.2 |
| L3 (15 degrees *) | 0.3212 | 0.3296 | 7442 | 15863.3 | 53.9 | 0.3674 | 0.3746 | 4359 | 4435.8 | 25.6 |
| L4 (20 degrees *) | 0.3222 | 0.3322 | 7323 | 12267.0 | 41.6 | 0.3520 | 0.3641 | 4800 | 1982.9 | 11.4 |
| L5 (25 degrees *) | 0.3247 | 0.3367 | 7076 | 8456.3 | 28.7 | 0.3507 | 0.3449 | 4755 | 1135.4 | 6.5 |
| L6 (30 degrees *) | 0.3292 | 0.3424 | 6720 | 6056.6 | 20.6 | 0.3639 | 0.3647 | 4406 | 620.4 | 3.6 |

* to the left

VEHICLE LIGHT

This application claims the priority benefit under 35 U.S.C. §119 of Japanese Patent Application No. 2009-234436 filed on Oct. 8, 2009, which is hereby incorporated in its entirety by reference. This application is also related to and incorporates by reference U.S patent application Ser. No. 12/901,486 entitled Vehicle Light filed on the same date, Oct. 8, 2010, and assigned to the same entity.

TECHNICAL FIELD

The presently disclosed subject matter relates to a vehicle light, and in particular, relates to a vehicle light having a light emitting diode (LED) serving as a light source and an optical system for controlling light distribution pattern of the light beams from the LED light source utilizing a light guide (being a lens body having an inner reflecting surface), thereby projecting illumination light with a low-beam light distribution pattern, for example.

BACKGROUND ART

Japanese Patent Application Laid-Open No. 2008-078086 discloses a vehicle light having a light emitting diode (LED) as a light source and a light guide for controlling the light distribution pattern of light beams from the LED. FIG. 1 is a vertical cross sectional view illustrating the configuration of a conventional vehicle light. As shown, the vehicle light has a light source 100 including a light emitting device 100*a* facing upward. A light guide 102 is disposed above the light source 100. The light guide 102 includes a light incident surface 104, a reflecting surface 106, and a light exiting surface 108. Light beams emitted from the light source 100 can enter the light guide 102 through the light incident surface 104. The reflecting surface 106 is disposed near the rear side of a vehicle body and the entering light beams can be reflected by the reflecting surface 106 to be directed in the forward direction of the vehicle body. The reflected light beams exit through the light exiting surface 108 disposed near the front side of the vehicle body.

The vehicle light utilizing this type of light guide can project the image of the LED light source by the light guide while the image is enlarged, thereby forming a predetermined light distribution pattern. Accordingly, if the light beams emitted from the LED light source from various points of the light emitting surface have chromaticity variation (color shading), the color shading may appear in the illumination light to be projected from the light guide, thereby generating illumination light with color shading. In general, an LED light source may generate color shading, in particular, at its edge areas of the light emitting surface with ease. As a result, color shading can occur at the boundary portion of the light distribution pattern. If the illumination light has such color shading, when an object with monochromatic color is illuminated therewith, the object can be observed with different colors at different positions, thereby degrading the color rendering properties. In order to cope with this problem, it is sometimes helpful to strictly control the managing conditions of the light source with regard to color shading. However, this may hinder the mass production of light sources and also prevent cost reduction.

SUMMARY

The presently disclosed subject matter was devised in view of these and other problems and features and in association with the conventional art. According to an aspect of the presently disclosed subject matter, a vehicle light can have a light emitting diode (LED) serving as a light source and an optical system for controlling a light distribution pattern of the light beams from the LED light source utilizing a light guide (being a lens body having an inner reflecting surface). The vehicle light can reduce the color shading of illumination light which is mainly generated at the boundary of the light distribution pattern due to the color shading of the LED light source by the light distribution control by the light guide. As a result, the illumination light can be formed with less color shading while maintaining favorable color rendering properties under alleviated managing conditions with regard to the color shading of the LED light source. Furthermore, this configuration can improve the mass production yield of the vehicle light with reduced cost.

According to another aspect of the presently disclosed subject matter, a vehicle light can include: an LED light source for emitting visible light at a plurality of wavelengths, the LED light source having a light emitting surface at an edge of which color shading occurs; and a lens body having a light incident surface, a reflecting surface, and a light exiting surface, in which light beams from the LED light source can enter the lens body through the light incident surface and be reflected by the reflecting surface in a predetermined direction to exit from the lens body through the light exiting surface so that an image of the light emitting surface of the LED light source can be enlarged and projected by the lens body and the light beams exiting from the lens body can form illumination light with a predetermined light distribution pattern. In this configuration, the reflecting surface can be formed so that light beams emitted from the edge of the LED light source can exit through the light exiting surface of the lens body so as to be directed while spread to a boundary and an inner area of the light distribution pattern. By doing so, the light beams emitted from the edge of the LED light source can be overlaid over light beams emitted from an area other than the edge of the light emitting face of the LED light source.

According to the presently disclosed subject matter, the light beams emitted from the edge of the LED light source can be mixed with the light beams emitted from the other area of the LED light source, thereby reducing the occurrence of color shading of illumination light due to the color shading at the edge of the LED light source.

In the vehicle light configured as described above, the lens body can have a refractive optical path configured to direct the light beams emitted from the edge of the LED light source to or near the boundary of the light distribution pattern and refract the light beams by at least any one of the light incident surface and the light exiting surface, and the reflecting surface can include a refractive optical path reflecting portion configured to reflect the light beams passing through the refractive optical path, the refractive optical path reflecting portion being formed such that the light beams that have passed through the refractive optical path to be subjected to color separation at all the wavelengths can exit from the lens body through the light exiting surface to the boundary of or within the light distribution pattern. The light beams emitted from the edge of the LED light source can exit from the light exiting surface of the lens body so as to be spread in a direction of a boundary or inner area of the light distribution pattern by the refractive optical path reflecting portion.

According to the presently disclosed subject matter, the color blurring due to color separation of the lens body can be prevented from occurring at the boundary of the light distribution pattern. Accordingly, both the color shading of the illumination light due to chromatic dispersion of the lens body and the color shading of the illumination light due to color shading of the LED light source can be prevented.

In the vehicle light configured as described above, the light source and the lens body can constitute a light source unit, and the vehicle light can include a plurality of the light source units. In this configuration, each of the light source units can have a different light distribution pattern, and the different light distribution patterns from the plurality of light source units can be overlaid with each other to form the required light distribution pattern as a vehicle light, thereby illuminating a pedestrian's side road with a wider range.

According to the presently disclosed subject matter, a plurality of light source units each having the LED light source and the lens body as described above can be combined to constitute a single vehicle light for forming the required light distribution pattern. Accordingly, the vehicle light can illuminate a wider area with illumination light having less color shading.

In a vehicle light configured as described above, the LED light source can include a light emitting diode and a wavelength conversion material.

According to the presently disclosed subject matter, the LED light source having a light emitting diode and a wavelength conversion material can emit light with less color shading at the edge of the light emitting surface of the LED light source, thereby suppressing the occurrence of the color shading of the illumination light.

Accordingly, a vehicle light made in accordance with the principles of the presently disclosed subject matter can have an LED light source and a light guide for projecting the light beams passing therethrough to form a desired light distribution pattern with the light guide being a lens body having an inner reflecting surface. The vehicle light can reduce the color shading of illumination light due to the color shading of the LED light source by the light distribution control by the light guide. As a result, the illumination light can be formed with less color shading while maintaining favorable color rendering properties under alleviated managing conditions with regard to the color shading of the light source. Furthermore, this configuration can improve the yield of mass production of the vehicle light with reduced cost.

BRIEF DESCRIPTION OF DRAWINGS

These and other characteristics, features, and advantages of the presently disclosed subject matter will become clear from the following description with reference to the accompanying drawings, wherein:

FIG. 6 is a table indicating the measured value of chromaticity and light intensities within the light distribution pattern of the illuminated light from the vehicle light of FIG. 2;

DESCRIPTION OF EXEMPLARY EMBODIMENTS

A description will now be made below to exemplary vehicle lights made in accordance with principles of the presently disclosed subject matter with reference to the accompanying drawings and in accordance with exemplary embodiments.

Figure 1:
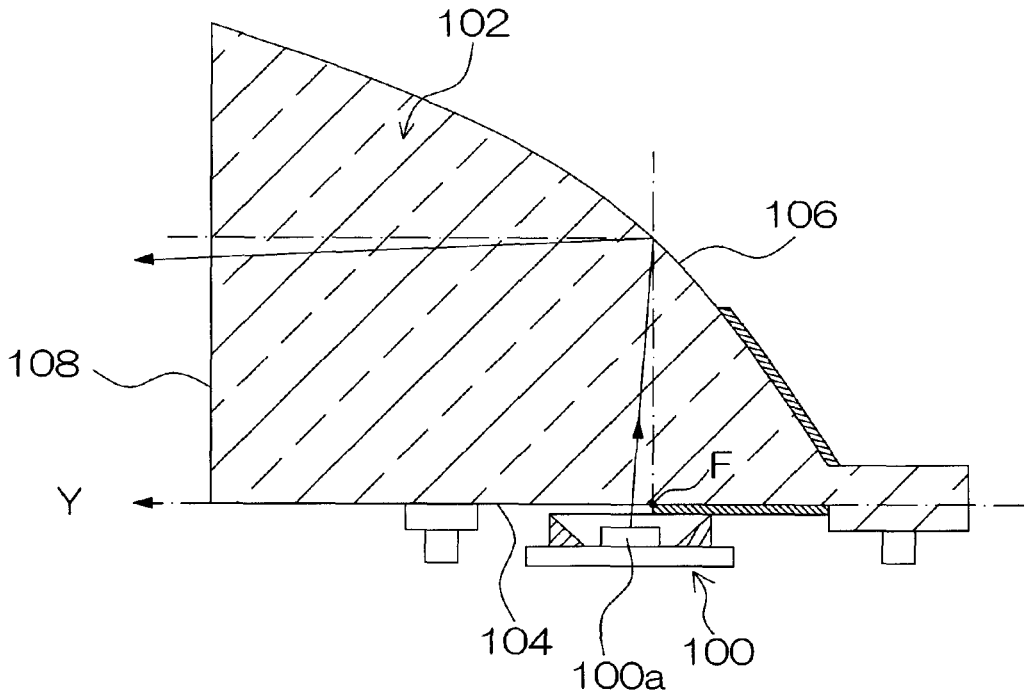
Fig. 1 Conventional Art
FIG. 1 is a vertical cross sectional view illustrating a conventional vehicle light utilizing a light guide.
Figure 2:
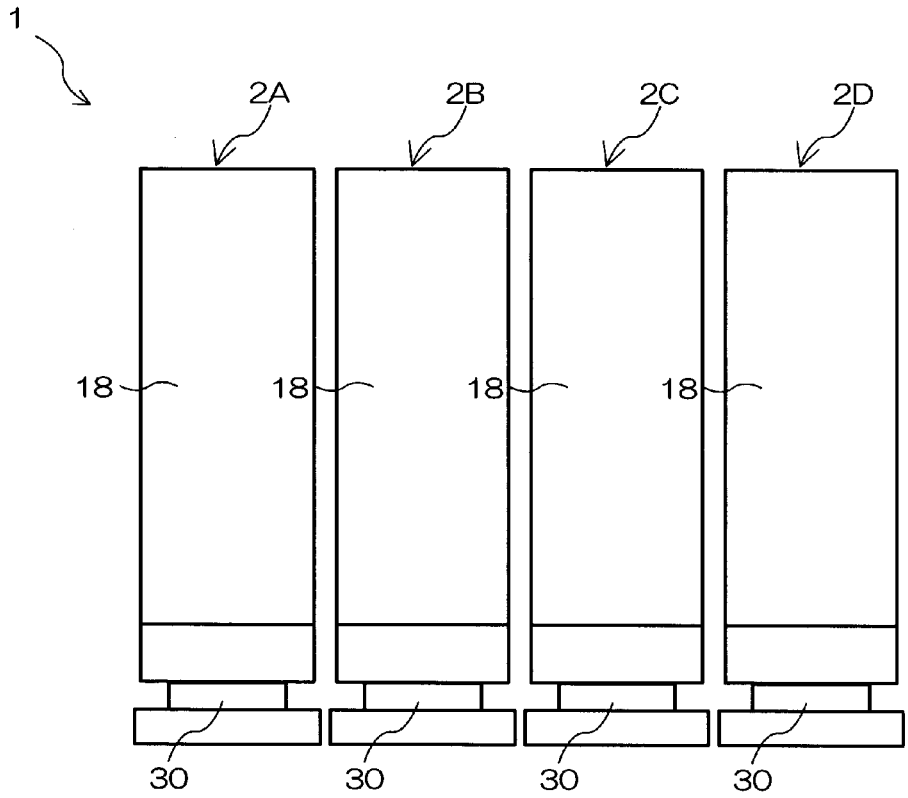
FIG. 2 is a front view illustrating a schematic configuration of a vehicle light made in accordance with principles of the presently disclosed subject matter.

FIG. 2 is a front view of a vehicle light 1 made in accordance with principles of the presently disclosed subject matter. The vehicle light 1 can be employed, for example, as a headlight for a low beam for use in an automobile, a motorcycle, other vehicle, and the like and can include a plurality of (four in the illustrated example) light source units 2A, 2B, 2C, and 2D. Each light source unit can include an LED light source and a lens body serving as a light guide. The light source units 2A, 2B, 2C, and 2D can, for example, have the same configuration, but emit light beams with different light distribution sub-patterns. The illumination light emitted from the respective light source units 2A, 2B, 2C, and 2D through each respective light exiting surface of the lens body thereof can be overlaid over each other at least in part to form a low beam light distribution pattern for the entire vehicle light 1. The illustrated vehicle light 1 has four light source units horizontally arranged in line, but the presently subject matter is not limited to this arrangement. The arrangement and the number of the light source units may be appropriately selected according to the intended purposes and specification of the vehicle light.

Figure 3:
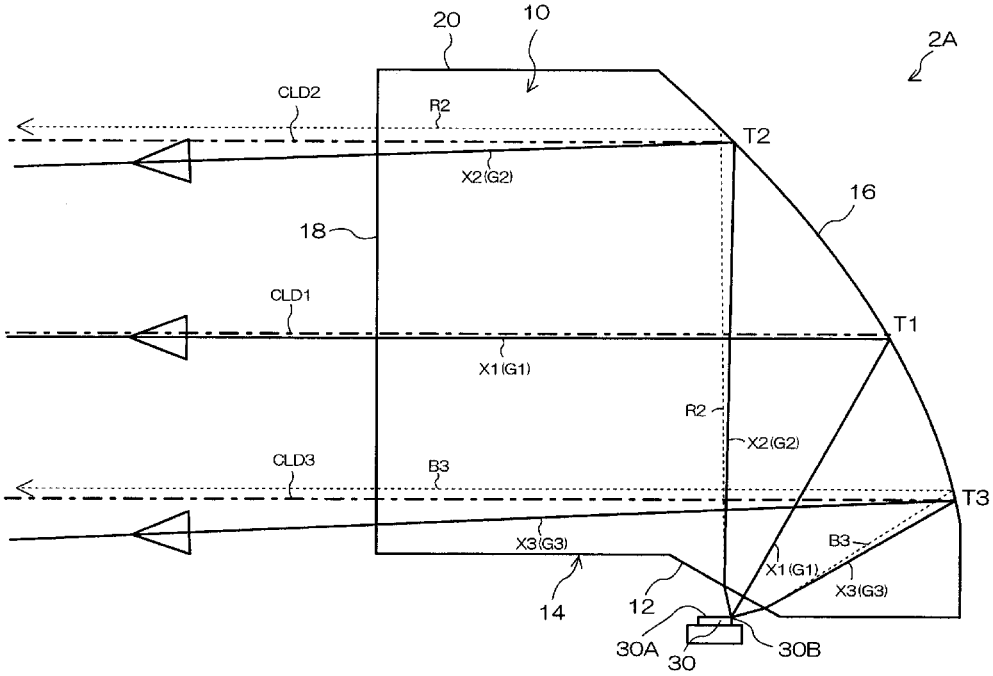
FIG. 3 is a vertical cross sectional view illustrating the configuration of a light source unit of a vehicle light made in accordance with principles of the presently disclosed subject matter.

FIG. 3 is a vertical cross sectional view illustrating the configuration of one of the light source unit (2A) of the vehicle light 1. The light source unit 2A as shown in FIG. 3 can include a lens body 10 which is a light guide and can be injection molded by, for example, a polycarbonate material being a high heat resistant, transparent resin. The light source unit 2A can also include an LED light source 30 and other components (not shown).

The lens body 10 can have a bottom 14 including a light incident surface 12, a reflecting surface 16 which is arranged near the rear side of the vehicle body (in the rear portion of the light), a light exiting surface 18 which is arranged near the front side of the vehicle body, and a top surface 20 which is arranged on top of the lens body 10. The lens body 10 can be defined by these surfaces as well as the side surfaces.

The light incident surface 12 can be a surface that receives light beams emitted from the LED light source 30 so that the light beams can enter the lens body 10 therethrough. In the illustrated example, the light incident surface 12 can be formed by a slightly inclined surface with respect to the horizontal plane (not shown) toward the rear side of the vehicle body. The remaining surfaces of the bottom 14 other than the light incident surface 12 can be formed by horizontal planes.

The reflecting surface 16 can be a surface that can reflect light beams that arrives after being emitted from the light source 30 and passing through the light incident surface 12 into a predetermined direction, and can be formed as, for example, a part of a revolved paraboloid or the like. The reflecting surface 16 can be formed of an inner surface with total reflection property or a reflecting film adhered to the outer surface of the transparent lens body 10 with the reflecting film formed from metal such as aluminum.

The light exiting surface 18 can be formed of a vertical plane that is perpendicular to the horizontal plane, and can be a surface through which the light beams reflected by the reflecting surface 16 can exit.

The LED light source 30 can be a light source having one or a plurality of LED chips in a single package to emit white light beams. The LED light source 30 can have a planar light emitting surface 30A facing upward in a substantially vertical direction. For example, the LED light source 30 can include an InGaN-based LED chip 200 that emits blue light beams as an LED chip, a circuit board 202 on which the LED chip 200 is mounted (see FIGS. 11A, 11B, and 11C), and a wavelength conversion layer 204 disposed on the LED chip 200. The wavelength conversion layer 204 can be prepared by dispersing, for example, well-known YAG phosphor in a silicone resin. In this configuration, the blue light beams from the LED chip 200 and yellow light beams that are generated by wavelength converting the blue light beams by the YAG phosphor (light containing red color component and green color component) can be mixed with each other to generate white light beams. The light emitting surface 30A is not limited to a planar shape, but may be convex.

Figure 11A:
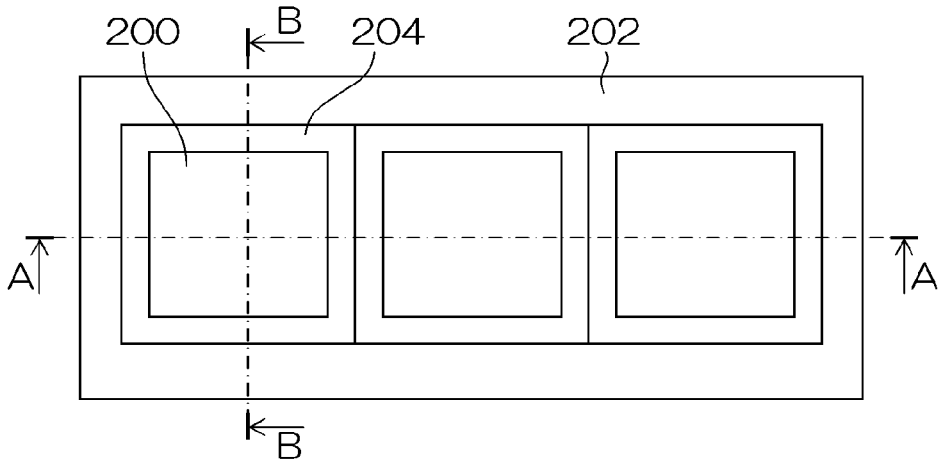
FIGS. 11A, 11B and 11C are a plan view, a cross sectional view taken along line B-B of FIG. 11A, and a cross sectional view taken along line A-A of FIG. 11A of the exemplary configuration of an LED light source, respectively.
Figure 11B:
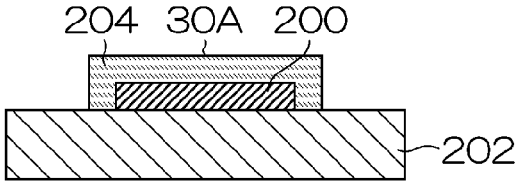
Figure 11C:
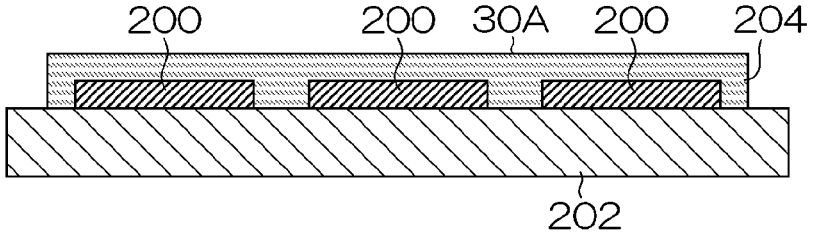

As shown in FIGS. 11A, 11B, and 11C, the LED light source 30 can include three InGaN-based LED chips 200 arranged in line at predetermined intervals. As shown in FIGS. 11B and 11C, the wavelength conversion layer 204 covers the LED chips 200 at their top surfaces and side surfaces in a rectangular shape while the top surface of the wavelength conversion layer 204 is formed in a flat shape. In order to form the top surface of the wavelength conversion layer 204 in a flat shape, a liquid light-transmitting resin material containing the wavelength conversion material dispersed therein can be coated by printing or the like, followed by curing.

Figure 4:
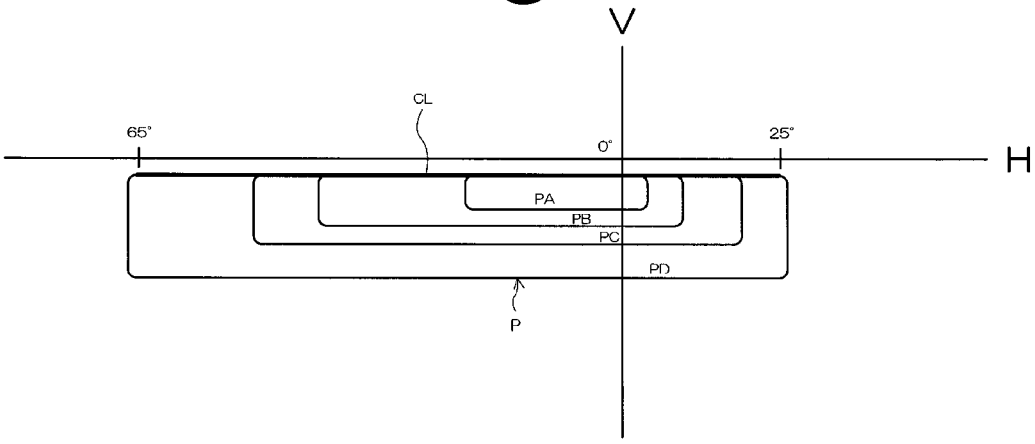
FIG. 4 is a diagram illustrating a light distribution pattern formed by the vehicle light of FIG. 2.

The light source units 2B to 2D can have the same or similar configuration as that of the light source unit 2A. The vehicle light 1 can be provided with these light source units 2A, 2B, 2C, and 2D, and the light beams emitted from these light source units 2A to 2D can be overlaid over each other so as to form a light distribution pattern for a low beam as shown in FIG. 4. The vehicle light 1 of the presently disclosed subject matter can be used as a headlamp for an automobile for a left-side traffic system. When the vehicle light is adopted for a headlamp for an automobile for a right-side traffic system, the arrangement of the components are horizontally reversed, thereby forming a desired light distribution pattern that is horizontally reversed.

FIG. 4 includes an H line along which a horizontal angle with respect to the direction of the center front of the vehicle light 1 (the standard direction) is shown (as well as being the basis for the horizontal level of the vehicle light 1) and a V line along which a vertical angle is shown with respect to the standard direction (as well as showing the center position in the right-to-left direction at the intersection between the H line and the V line).

As shown in FIG. 4, the light distribution pattern P of the vehicle light 1 can include a light distribution area within an angular range below the H line and wide in the right-to-left direction. Specifically, the light distribution area ranges to approximately 25 degrees to the right and approximately 65 degrees to the left from the V line, where the illumination light can be projected. The upper edge of the light distribution pattern P can include a bright-dark boundary line CL (referred to as a cut-off line) showing the boundary between the bright area where the light beams reach and the dark area where the light beams do not reach. The bright-dark boundary line CL is formed near the H line (for example, lower by 0.57 degrees with respect to the H line).

As shown, the light distribution pattern P can be composed of a plurality of light distribution sub-patterns (light distribution sub-areas) PA to PD corresponding to the respective light source units 2A to 2D. For example, the light source unit 2A can form the light distribution sub-pattern PA for illuminating the narrow area near the center point of H-V lines (deviation degree from H and V lines=zero degrees). The light source units 2B and 2C can form the light distribution sub-patterns PB and PC for illuminating a broader area than the sub-pattern PA while overlapping with the sub-pattern PA, respectively. The light source unit 2D can form the largest light distribution sub-pattern PD covering the light distribution sub-patterns PA, PB, and PC. It should be noted that the correspondences between the light source units 2A to 2D and the light distribution sub-patterns PA to PD are not limited to the above example, as well as any desired light distribution pattern P can be formed in accordance with the intended use and specification of the vehicle light 1. The number of the light source units is not limited to four, but may be two, three, or five or more.

The light source units 2A to 2D can be formed on the basis of the same or similar optical design scheme. For example, the optical design scheme of the light source unit 2A can be achieved by the following. First, suppose the LED light source 30 emits white light beams from various portions of the light emitting surface 30A to various directions (where the white light beams can include light beams at visible wavelengths). In this case, the physical relationship of the LED light source 30 and the lens body 10 and the target illumination directions of the white light beams (target exiting directions when the white light beams exit from the lens body 10) can be determined so that the desired light distribution sub-pattern PA can be formed as shown in FIG. 4. Then, the shapes of the light incident surface 12, the reflecting surface 16, and the light exiting surface 18 of the lens body 10 are set so that various directions of the white light beams emitted from the light emitting surface 30A coincide with the target illumination directions. In the present exemplary embodiment, the reflecting surface 16 made of a partial revolved parabola can be set so that the image of the light emitting point 30B at the rearmost end of the light emitting surface 30A with respect to the front-to-rear direction of the vehicle body is enlarged and projected to the bright-dark boundary line CL, thereby forming the cut-off line. This setting is done because the setting of the rearmost end corresponding to the bright-dark boundary line CL can limit the light from the foremost end of the light emitting surface 30A to be downward with respect to the bright-dark boundary line CL, thereby preventing the generation of upward glare light above the H line.

The refracting angle at the light incident surface 12 and the light exiting surface 18 with respect to the incident angle can be determined by a refractive index corresponding to the material employed for forming the lens body 10. This value can be used during the optical designing. If the refractive index can vary depending on the wavelength of light, a refractive index at a particular standard wavelength (hereinafter, referred to as a standard refractive index) can be used as an approximation which is assumed as a constant refractive index over the entire range of wavelengths for white light (visible range). In the present exemplary embodiment, the optical design scheme can be achieved by adopting the wavelength of green color, which is an approximate center wavelength of white light, as a standard wavelength, and the refractive index at the wavelength of green color as a standard refractive index, and assuming that the standard refractive index is constant over the entire range of wavelengths for white light. Based on these settings, the light incident surface 12, the reflecting surface 16, and the light exiting surface 18 of the lens body 10 can be designed in shape and the like so as to provide the light distribution sub-pattern PA as shown in FIG. 4.

Figure 5:
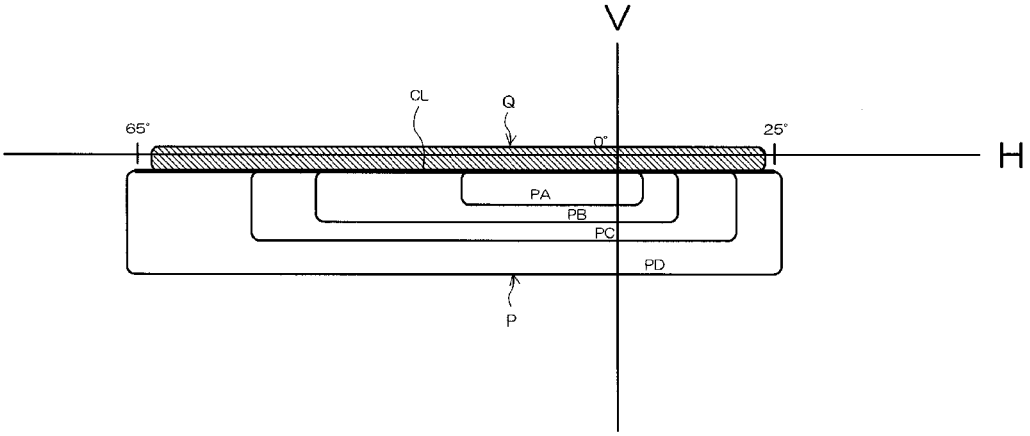
Fig. 5 Conventional Art
FIG. 5 is a diagram illustrating a color blurring occurring at and near the bright-dark boundary line generated by a comparative vehicle light with a configuration similar to that of FIG. 2.

When the lens body 10 is formed of a transparent resin material, the refractive index thereof may vary at various wavelengths more than that of a glass lens formed of an inorganic material. In particular, a polycarbonate material having superior transparency, heat resistance and weather resistance has a refractive index which can significantly vary at various wavelengths and generate large chromatic dispersion. In this case, if the optical design scheme is determined to provide the desired light distribution sub-pattern PA of FIG. 4 with the assumed standard refractive index, an unintended illumination area with color separation may be adversely formed above the bright-dark boundary line CL of the light distribution sub-pattern PA (being a color blurring area). This phenomenon can also occur in the case of optical designing of the other light source unites 2B to 2D. In this case, the unintended, color-separated illumination area Q may be formed as a whole above the bright-dark boundary line CL of the light distribution pattern P of the vehicle light 1, as shown in FIG. 5. It should be noted that the chromatic dispersion means the dispersion of light of which phenomenon can occur for a material having various refractive indices depending on wavelengths of incident light beams.

In general, the lens body 10 can enlarge and project the image of the light emitting surface 30A of the LED light source 30 to provide the light distribution sub-pattern PA on a virtual plane as shown in FIG. 4. Suppose a case where the optical designing is performed by adopting a constant standard refractive index with respect to the entire range of wavelengths of white light beams without considering the chromatic dispersion by the lens body 10 so as to provide the light distribution sub-pattern PA of FIG. 4. In this case, the physical relationship between the light emitting surface 30A of the LED light source 30 and the lens body 10 can be determined so that the light emitting point 30B at the rearmost end of the light emitting surface 30A is positioned at the focus of the entire lens body 10. Please note that "the focus of the entire lens body 10" shall mean the focal position controlled while taking the effect of refraction by the light incident surface 12 with respect to the focal position of the parabolic reflecting surface 16 into consideration. In this case, white light beams emitted from the light emitting point 30B in various directions should exit to the target bright-dark boundary line CL by a certain vertical angle while being collimated. Then, the optical designing is performed such that white light beams emitted from other light emitting points than the point 30B (points closer to the front side than the point 30B) of the light emitting surface 30A should exit to the angular range below the certain vertical angle from the target bright-dark boundary line CL.

In the above-mentioned optical design scheme, suppose the case where the actual chromatic dispersion occurring in the lens body 10 is taken into consideration. The white light beams emitted from the light emitting point 30B may contain light beams that pass through the light incident surface 12 and the light exiting surface 18 along an optical path without refraction at both the surfaces 12 and 18 (non-refractive optical path). These light beams can be projected to the target bright-dark boundary line CL by a certain vertical angle. The white light beams may contain light beams that pass through the light incident surface 12 and the light exiting surface 18 along an optical path with refraction at either the surface 12 or 18 (refractive optical path). In this case, the light beams other than the green light beams with the standard refractive index, namely, red and blue light beams with longer or shorter wavelength than the standard wavelength may be separated from the green light beams because of different refractive indices from the standard refractive index (in the case of green light beams). The separated light beams may be directed in different directions from that of the green light beams at the surface where the refraction of the lens body 10 occurs. As a result, part of the red or blue light beams may be projected to the upper area that is higher than the target bright-dark boundary line CL by an upward angle, thereby generating a color blurring area above the target bright-dark boundary line CL. Accordingly, the unintended illumination area Q can be formed above the target bright-dark boundary line CL as shown in FIG. 5. This illumination area Q may hinder the formation of the uniform chromaticity of the light distribution pattern (namely, can generate color shading) as well as may generate upward light beams above the H line.

In view of the conventional optical design scheme where the optical designing is performed by adopting a constant standard refractive index with respect to the entire range of wavelengths of white light beams without considering the chromatic dispersion by the lens body 10, the presently disclosed subject matter can provide an adjustment (correction) by taking the chromatic dispersion of lens body 10 with regard to white light beams emitted from the light emitting point 30B of the light emitting surface 30A (or the variation in refractive index wavelength by wavelength) into consideration. Specifically, the physical relationship between the LED light source 30 and the lens body 10 that constitute the basic structure of the light source unit 2A and the structure of the lens body 10 (the shape and the like of the light incident surface 12, the reflecting surface 16, and the light exiting surface 18) can be adjusted (corrected) so that the color blurring (namely, the unintended illumination area Q) is prevented from being generated above the bright-dark boundary line CL.

For example, the polycarbonate material has an optical property that the longer the wavelength is within the wavelength range of approx. 380 nm to approx. 780 nm being the wavelengths of white light beams (visible range), the smaller refractive index is observed. For example, the polycarbonate material shows the refractive indices of 1.6115, 1.5855, and 1.576 at the wavelengths of 435.8 nm (blue), 546.1 nm (green), and 706.5 nm (red), respectively. In this case, if the standard shape for the light incident surface 12, the reflecting surface 16, and the light exiting surface 18 of the lens body 10 is designed, the standard wavelength is employed as 546.1 nm for green light beams as well as the standard refractive index of 1.5855 is set. Furthermore, to cope with the chromaticity dispersion by the lens body 10, the red light beams at 706.5 nm and the blue light beams at 435.8 nm can be considered as the longest wavelength and the shortest wavelength. Based on these light beams at the respective wavelengths, the light incident surface 12, the reflecting surface 16, and the light exiting surface 18 of the lens body 10 can be adjusted from the standard shape. It should be noted that these specific wavelengths may be changed according to the intended use, specification, material properties, and the like.

It should be noted that in the present exemplary embodiment the adjustment (correction) is made only on the reflecting surface 16, but the light incident surface 12 and the light exiting surface 18 remain to have the standard shape (flat plane) (that has been designed with the standard refractive index).

Further, the light exiting surface 18 of the lens body 10 can be formed of a vertical flat plane as described above, and the chromatic dispersion may not occur or may scarcely occur due to the horizontally collimated exiting light beams that have been reflected by the reflecting surface 16 through the light exiting surface 18 toward the target bright-dark boundary line CL. Accordingly, in order to facilitate the understanding, it is assumed that the chromatic dispersion and color separation cannot occur by the light exiting surface 18 and the directions of light beams exiting through the light exiting surface 18 coincide with the directions of light beams reflected by the reflecting surface 16.

Hereinafter, a description will be given of how the adjustment (correction) of the shape of the lens body 10 is done. The lens body 10 of FIG. 3 can be configured by adjusting (correcting) the shape of the reflecting surface 16 of the lens body 10 while taking the chromatic dispersion due to the varied reflective indices depending on respective wavelengths into consideration, so that the color blurring (unintended illumination area Q) is prevented from being generated above the bright-dark boundary line CL. In FIG. 3, optical paths as determined by using the basic refractive index (the optical paths when the constant basic refractive index at entire range of wavelengths of white light beams is used) are shown by solid lines. Specifically, the white light beams emitted from the light emitting point 30B of the LED light source 30 include white light beams X1 that are perpendicularly incident on the light incident surface 12 (incident angle=0 degrees) and white light beams X2 and X3 that are incident on the light incident surface 12 obliquely on the front side and rear side with respect to the white light beams X1, and the white light beams X1, X2, and X3 travel along the respective optical paths of solid line. As shown in FIG. 3, the white light beams X1, X2, and X3 emitted from the light emitting point 30B of the LED light source 30 can enter the lens body 10 through the light incident surface 12, be reflected by the reflecting surface 16, and then exit from the lens body 10 through the light exiting surface 18.

FIG. 3 also shows other optical paths CLD1, CLD2, and CLD3 as determined by using the constant standard refractive index with respect to the entire range of wavelengths of white light beams without considering the chromatic dispersion. The other optical paths CLD1, CLD2, and CLD3 are shown by dot and dash lines. CLD1 is the same optical path as X1 and along CLD2 and CLD3 the collimated light beams parallel to the CLD1 are projected to the outside through the light exiting surface 18. The optical paths CLD1, CLD2, and CLD3 can be obtained by the reflecting surface 16 formed of a revolved paraboloid having a focus at or near the light emitting point 30B (strictly, the focus can be positioned at a position slightly leftward and downward in the drawing with respect to the light emitting point 30B when taking the refraction by the light incident surface 12 into consideration). This shape is referred to as a basic shape. The optical paths CLD1, CLD2, and CLD3 indicated by the dot and dash lines are those through which white light beams X1, X2, and X3 are projected through the light exiting surface 18 toward the target bright-dark boundary line CL in a certain angular direction. As noted above, the light beams directed to the bright-dark boundary line CL are not refracted at the light exiting surface 18, and accordingly, the optical paths CLD1, CLD2, and CLD3 are indicated by the dot and dash straight lines from the reflecting surface 16 through the light exiting surface 18 to the outside of the lens body 10.

In the lens body 10 of the present exemplary embodiment, the shape of the reflecting surface 16 has been designed by taking the chromatic dispersion into consideration.

In this case, as the white light beams X1 can be incident on the light incident surface 12 perpendicularly without refraction by the light incident surface 12 and the light exiting surface 18 of the lens body 10. Accordingly, the target direction is set to the same angular direction toward the target bright-dark boundary line CL. The shape of the reflecting surface 16 can be designed to be matched to the basic shape (position and gradient) so that the white light beams X1 incident on the reflecting surface 16 at the position T1 can be reflected by a certain angle toward the bright-dark boundary line CL along the optical path CLD1.

Please note that the light incident surface 12 can be adjusted in terms of inclination angle so that the position T1 (where the white light beams X1 that are not subjected to refraction at the light incident surface 12 can be reflected by the reflecting surface 16) can be disposed at substantially vertical center of the reflecting surface 16. By doing so, the incident angles (refraction angle) of the light beams (which are all reflected by the reflecting surface 16) at the light incident surface 12 can be set as small as possible, thereby suppressing the occurrence of the chromatic dispersion. Furthermore, the non-refractive optical path (the light beams can be incident on the light incident surface 12 without refraction) can include the position T1 which is the same or similar to the basic shape.

On the other hand, the white light beams X2 and X3 which are subjected to refraction at the light incident surface 12 can be incident on the light incident surface 12 forward or rearward with respect to the white light beams X1. The white light beams X2 and X3 can be controlled to be directed in a lower angular direction than that toward the target bright-dark boundary line CL depending on the magnitude of the chromatic dispersion (color separation) by that refraction. Then, the reflecting surface 16 at the upper and lower positions T2 and T3 than the position T1 can be designed such that the white light beams X2 and X3 entering the lens body 10 can be reflected by the reflecting surface 16 at the respective positions T2 and T2 to be projected in a lower angular direction than the angular direction of the bright-dark boundary line CL (being the optical paths CLD2 and CLD3).

As one example of the method for designing the reflecting surface 16 of the present exemplary embodiment by correcting the reflecting surface with the standard shape, there is an exemplary method in which the position T1 that is not corrected and has the same basic shape is allowed to serve as a reference point, and the points on the reflecting surface above the reference point are sequentially corrected as a corrected point. In this instance, one point of plural points can be corrected such that the reflecting surface 16 has an inclination by which the surface can reflect white light beams to the target illumination direction as corrected. Then, the determined inclination is applied to the area of the reflecting surface upwards of that point, thereby correcting the upper area with a corrected inclination without the necessity of entire correction. Then, another further upper point can be corrected in the same way as above to correct that point as well its upper area with a corrected inclination. This process is repeated until the end portion of the reflecting surface. The area lower than the position T1 can be corrected by repeating the above process, although the presently disclosed subject matter is not limited to this.

Specifically, a description will be given of how the white light beams X1, X2, and X3 emitted from the light emitting point 30B of the LED light source 30 can be projected through the lens body 10 if the shape of the reflecting surface 16 is designed by taking the chromatic dispersion into consideration as in the present exemplary embodiment.

The white light beams X1 can be perpendicularly incident on the light incident surface 12 where they are not subjected to refraction. Accordingly, while no chromatic dispersion (color separation) occurs, the white light beams X1 travel inside the lens body 10 to impinge on the reflecting surface 16 at the position T1. The white light beams X1 incident on the reflecting surface 16 can be reflected in a direction along the optical path CLD1 to be projected through the light exiting surface 18 in the angular direction of the target bright-dark boundary line CL. Namely, the optical paths of the white light beams X1, X2, and X3 are the examples when the refractive index is assumed to be a constant standard refractive index at the entire range of wavelengths of the white light beams. As mentioned above, the refractive index for green light beams is used as the standard refractive index. Accordingly, the green light beams G1 contained in the white light beams X1 can pass the same optical path as the white light beams X1 with or without the refraction and can be projected in the target angular direction of the bright-dark boundary line CL. Furthermore, the red and blue light beams other than green light beams contained in the white light beams X1 can pass the same optical path as the white light beams X1 because there are no refraction at the light incident surface 12 (and light exiting surface 18) and no color separation. Then, the red and blue light beams can be projected in the target angular direction of the bright-dark boundary line CL. By this configuration, the white light beams X1 that are emitted from the light emitting point 30B and perpendicularly incident on the light incident surface 12 can be projected in the angular direction of the target bright-dark boundary line CL while the light beams can remain white, thereby forming the bright-dark boundary line CL.

The white light beams X2 that are obliquely incident on the light incident surface 12 near the front side may be subjected to refraction, thereby generating chromaticity dispersion and then color separation within the lens body 10. In this case, the green light beams G2 contained in the white light beams X2 can impinge on the position T2 of the reflecting surface 16 while passing the same optical path as the white light beam X2 that has been determined with the constant standard refractive index. Then, the green light beams G2 can be reflected by the reflecting surface 16 in a lower angular direction than the optical path CLD2 to be projected in a lower angular direction than the target angular direction of the bright-dark boundary line CL.

On the other hand, the red light beams R2 contained in the white light beams X2 are represented by a dotted line disposed in the upper area in FIG. 3, and the refractive index at the red color wavelengths is smaller than the standard refractive index (being the refractive index at the green color wavelengths). Accordingly, the red light beams R2 can be refracted by a smaller refraction angle than that for the green light beams G2 at the light incident surface 12, travel through an optical path closer to the front side than the optical path of the white light beams X2 (optical path of the green light beams G2), and then impinge on the upper position near the position T2 of the reflecting surface 16. In this case, the red light beams R2 can be incident on the reflecting surface 16 by a larger incident angle than the white light beams X2 (green light beams G2). Thereby, the red light beams R2 may be reflected in an upper angular direction than the white light beams X2 (green light beams G2). In this case, according to the presently disclosed subject matter, the reflecting surface 16 at and near the upper position T2 can be designed such that the red light beam R2 cannot be projected in an upper angular direction than the target angular direction of the bright-dark boundary line CL while taking how the red light beams R2 are reflected by a limited upper angular direction with respect to the white light beams X2 (green light beams G2) into consideration. Accordingly, the red light beams R2 can be reflected by the reflecting surface 16 in an angular direction almost along the optical path CLD2 (directed to the bright-dark boundary line) or a lower angular direction than the optical path CLD2. By doing so, the red light beams R2 can be projected through the light exiting surface 18 in an angular direction not above the target bright-dark boundary line CL.

Although the drawings do not illustrate optical paths for the blue light beams contained in the white light beams X2, the same phenomenon occurs. Namely, the blue light beams can be refracted by a different refractive angle and separated at the light incident surface 12 and travel through a different optical path from the white light beams X2 (green light beams G2). In this case, however, the blue light beams can be projected through the light exiting surface 18 in a lower angular direction than the white light beams X2 (green light beams G2) in the opposite direction from the red light beam R2. By setting the reflecting surface 16 so that the red light beams R2 can be projected in the certain angular direction equal to or lower than the target bright-dark boundary line CL, the blue light beams can be consequently projected in an angular direction sufficiently lower than the target bright-dark boundary line CL.

The white light beams X3 that are obliquely incident on the light incident surface 12 near the rear side may be subjected to refraction, thereby generating chromaticity dispersion and then color separation within the lens body 10. In this case, the green light beams G3 contained in the white light beams X3 can impinge on the position T3 of the reflecting surface 16 while passing the same optical path as the white light beam X3 that has been determined with the constant standard refractive index. Then, the green light beams G3 can be reflected by the reflecting surface 16 in a lower angular direction than the optical path CLD3 so as to be projected in a lower angular direction than the target angular direction of the bright-dark boundary line CL.

On the other hand, the blue light beams B3 contained in the white light beams X3 are represented by a dotted line in FIG. 3, and the refractive index at the blue color wavelengths is larger than the standard refractive index (being the refractive index at the green color wavelengths). Accordingly, the blue light beams B3 can be refracted by a larger refraction angle than that for the green light beams G3 at the light incident surface 12, travel through an optical path closer to the front side than the optical path of the white light beams X3 (optical path of the green light beams G3), and then impinge near the position T3 of the reflecting surface 16 (on the upper position adjacent to the position T3). In this case, the blue light beams B3 can be incident on the reflecting surface 16 by a larger incident angle than the white light beams X3 (green light beams G3). Thereby, the blue light beams B3 may be reflected in an upper angular direction than the white light beams X3 (green light beams G3). In this case, according to the presently disclosed subject matter, the reflecting surface 16 at and near the lower position T3 can be designed such that the blue light beam B3 cannot be projected in an upper angular direction than the target angular direction of the bright-dark boundary line CL while taking how the blue light beams B3 are reflected by a limited upper angular direction with respect to the white light beams X3 (green light beams G3). Accordingly, the blue light beams B3 can be reflected by the reflecting surface 16 in an angular direction almost along the optical path CLD3 (directed to the bright-dark boundary line) or a lower angular direction than the optical path CLD3. By doing so, the blue light beams B3 can be projected through the light exiting surface 18 in an angular direction not above the target bright-dark boundary line CL.

Although the drawings do not illustrate optical paths for the red light beams contained in the white light beams X3, where the same phenomenon occurs. Namely, the red light beams can be refracted by a different refractive angle and separated at the light incident surface 12 and travel through a different optical path from the white light beams X3 (green light beams G3). In this case, however, the red light beams can be projected through the light exiting surface 18 in a lower angular direction than the white light beams X3 (green light beams G3) in the opposite direction from the blue light beam B3. By setting the reflecting surface 16 so that the blue light beams B3 can be projected in the angular direction equal to or lower than the target bright-dark boundary line CL, the red light beams can be consequently projected in an angular direction sufficiently lower than the target bright-dark boundary line CL.

As described above, the light source unit 2A according to the present exemplary embodiment can include the LED light source 30 that emit white light beams. Among the white light beams from the light emitting point 30B of the LED light source 30, light beams just like the white light beams X1 that can pass through the non-refractive optical path where the chromatic dispersion (color separation) cannot occur without refraction can be projected in the angular direction to the bright-dark boundary line CL, thereby being capable of forming the clear bright-dark boundary line CL. By forming the bright-dark boundary line CL with the white light beams X1, the chromaticity of the bright-dark boundary line CL can be held within the range of white.

On the other hand, as described above, the white light beams include the white light beams X2 and X3 that pass through the refractive optical path where the chromatic dispersion may occur due to the refraction. In this case, the target illumination directions that have been determined with the constant standard refractive index at the entire range of wavelengths of the white light beams can be set to the lower angular direction than the bright-dark boundary line CL. Accordingly, the red and blue light beams to be projected in the upper angular direction than the green light beams due to the chromaticity dispersion can be projected in the direction toward the bright-dark boundary line CL or in an angular direction lower than the direction to the CL. Namely, the light beams at the wavelengths where the color separation occurs can be projected to the light distribution sub-pattern PA on the lower side of the bright-dark boundary line CL and be mixed with other illumination light from light emitting points other than the light emitting point 30B in the light distribution pattern. Accordingly, any problem due to the chromatic dispersion, such as the unintended illumination area Q formed above the bright-dark boundary line CL, can be prevented, thereby suppressing color shading of illumination light.

In the above description, we have paid attention to the light beams emitted from the light emitting point 30B of the LED light source 30. However, needless to say, the white light beams emitted from other points near the light emitting point 30B (closer to the front side) can generate red and blue light beams upward than green light beams contained therein due to the chromatic dispersion. As discussed above, however, the shape of the reflecting surface 16 can be corrected in accordance with the above described manner, thereby being capable of projecting these light beams to the lower area than the bright-dark boundary line CL. Accordingly, the problem where the unintended illumination area Q is generated due to the color shading can be resolved. Furthermore, the light beams that are emitted from the adjacent light emitting points near the light emitting point 30B and subjected to color separation may not be concentrated at a certain point with the same color light beams while being spread to a certain degree to be mixed with the other light beams from the other light emitting points. This can suppress the color shading of illumination light within the light distribution sub-pattern PA.

Herein, the chromatic dispersion by the lens body 10 can be generated by the white light beams that are emitted from the light emitting points 30B and the like and be incident on the light incident surface 12 by a certain incident angle to pass through the refractive optical path. In this case, the light beams at various wavelengths by color separation due to the chromatic dispersion may be projected in various directions through the light exiting surface 18. In principle, in the presently disclosed subject matter, the white light beams passing through optical paths for directing the light to the area other than the edge area of the light distribution sub-pattern PA can be mixed with other light beams from other light emitting points, thereby suppressing the generation of the color shading of the mixed illumination light even when the color separation occurs.

On the other hand, like white light beams passing through the refractive optical path to the direction of the upper edge area of the light distribution sub-pattern PA, or on or near the bright-dark boundary line CL, the white light beams that pass through the refractive optical path to the direction near the right edge, left edge and lower edge of the light distribution sub-pattern PA may be color separated during the passing through the refractive optical path. In this case, it may be possible that part of light beams color separated with a particular wavelength range (for example, red light, blue light, or mixed light thereof) can be projected outside the edges, thereby generating color blurring.

In order to cope with this problem, the light beams projected outside the edges can be corrected in a similar manner to the light beams to be projected on the bright-dark boundary line CL so that the light beams color separated for the entire range of wavelengths for white light can be projected within the target light distribution sub-pattern PA. This can be done by correcting the reflecting surface 16 from its basic shape, thereby directing the color separated light beams onto other light beams within the target light distribution sub-pattern PA. Accordingly, the color blurring near the edges can be prevented, thereby suppressing the color shading of the illumination light.

It should be noted that the color separated light beams to be projected on the boundary portion of the light distribution sub-pattern PA including the bright-dark boundary line CL can be projected not only within the light distribution sub-pattern PA, but also to other area(s) within the other light distribution pattern(s), thereby suppressing the color shading of the entire illumination light effectively. The color separated light beams can be used to enhance the whiteness of illumination light beams in a certain illumination area, thereby further effectively suppressing the color shading of the illumination light. Needless to say, the color separated light beams at various wavelengths can be directed to areas where the other light source units 2B to 2D project white brighter light beams.

The bright-dark boundary line CL can be formed by an LED light source having wavelength conversion materials, since the light flux emitted from an LED chip may not be shielded, thereby enhancing the light utilization efficiency (energy utilization efficiency). Accordingly, such a vehicle light utilizing an LED light source for forming the bright-dark boundary line CL for a low beam light distribution pattern near the H line provides excellent light qualities. For example, the LED light source 30 of FIG. 11 can include a wavelength conversion layer at the edge of the LED chip, and accordingly, the color shading may be easy to occur at the edge of the LED light source 30 than at the center portion thereof. Since the lens body 10 can enlarge and project the image of the LED light source 30, the color shading of the LED light source 30 may be projected to the bright-dark boundary line CL, which should be resolved. In the present exemplary embodiment, however, since the lens body 10 is designed to cope with the color dispersion problem with regard to the bright-dark boundary line CL as described above, even when the color shading occurs at the edges of the LED light source 30, such color shading can be suppressed.

Namely, the light beams emitted from the light emitting point 30B as shown in FIG. 3 can be directed from the direction of the bright-dark boundary line CL to the lower side, i.e., the inner area of the light distribution sub-pattern PA while being spread (due to the light spread by the color separation and the reflection at various points of the reflecting surface 16 to the wider exiting direction). The light beams emitted from the light emitting point 30B and other points of the LED light source 30 can be mixed with each other at various locations, thereby suppressing the color shading of illumination light due to the chromatic dispersion of the lens body 10 in addition to the color shading of illumination light caused by the color shading at the edges of the LED light source 30. In such a way, the presently disclosed matter can prevent the color shading of the illumination light of the vehicle light 1, and accordingly, the selection freedom of light sources used in the vehicle light can be widened because the design boundaries for the LED light source 30 has been relaxed. This means the quality control for the color shading occurring due to mass production of light sources can be widened in quality determination. The shape of the reflecting surface 16 can be corrected from the basic shape in order to prevent the occurrence of color blurring (color shading) due to the chromatic dispersion of the lens body 10 with regard to the boundary areas at left, right and lower edges of the light distribution sub-pattern PA, as in the case where the light beams are corrected and projected onto the bright-dark boundary line CL. Accordingly, the color shading of illumination light due to the color shading at the edges of the LED light source 30 around the boundary areas can be suppressed.

In order to facilitate the explanation, it can be understood that the white light beams X1 reflected at the position T1 can travel along the non-refractive optical path in the previous exemplary embodiment. Herein, the term "non-refractive optical path" may mean the optical path through which light beams cannot be subjected to refraction, as the narrowest sense. However, in some cases there is a necessity that the refraction at the light exiting surface 18 should be taken into consideration. Accordingly, the term "non-refractive optical path" herein shall mean the optical path that serves as a standard with small refraction in which the chromatic dispersion needs not be taken into consideration, as the broader definition.

Figure 7:
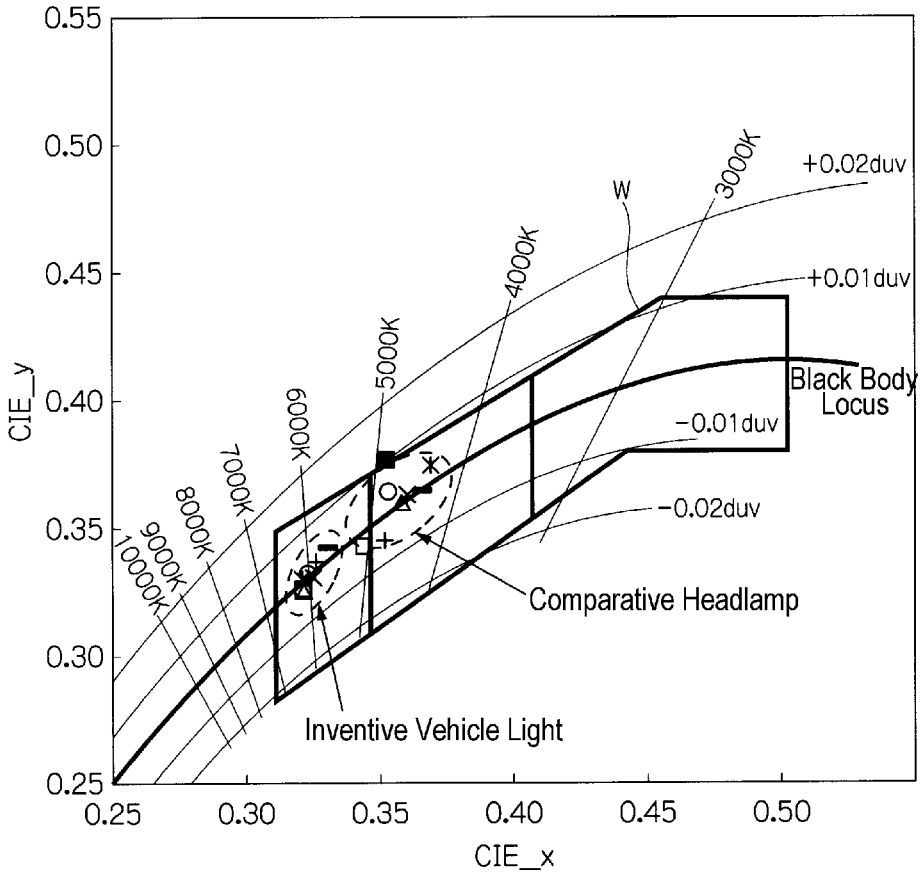
FIG. 7 is a chromaticity diagram in accordance with CIE color system, illustrating the chromaticity distribution based on the measured values listed in the table of FIG. 6.
Figure 8:
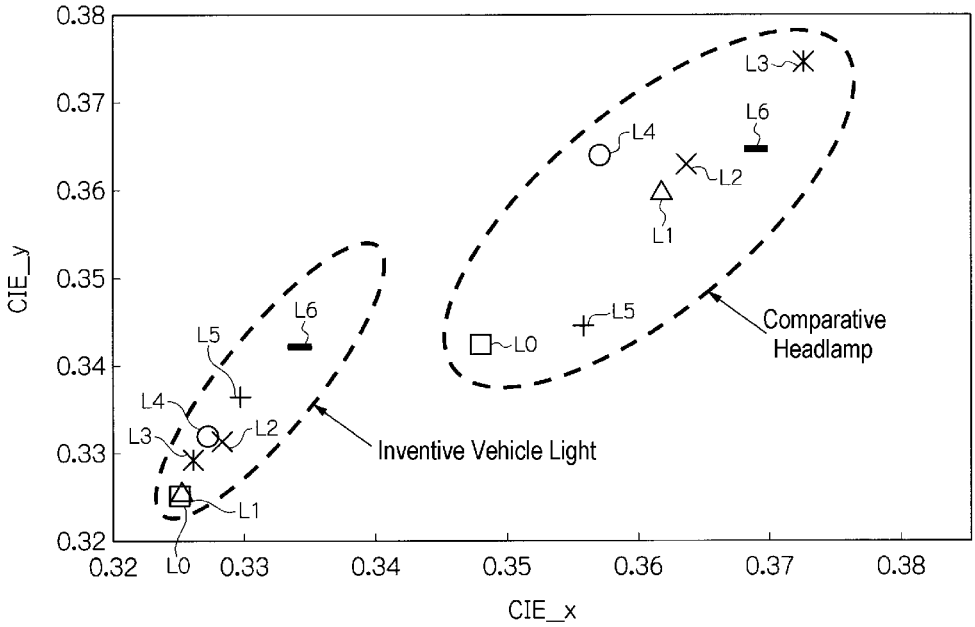
FIG. 8 is an enlarged view of part of the chromaticity diagram of FIG. 7.

FIG. 6 is a table indicating the measured values of chromaticity and intensity of light beams at different positions of the light distribution pattern P of the vehicle light 1 of FIG. 3 composed of the light source units 2A to 2D. Specifically, the measurement was carried out at six points of L0 to L6 from 0 degrees to 30 degrees in the left direction from the V line by 5 degrees in the horizontal direction while the vertical angular direction was fixed at 1 degree lower from the H line. FIGS. 7 and 8 show values represented by CIE color system that the measured chromaticity values are converted into. Herein, the x and y representing the chromaticity shall mean the values represented by CIE color system. FIGS. 6 to 8 include data with regard to the vehicle light 1 of the present exemplary embodiment (hereinafter, referred to as the inventive vehicle light) as well as a comparative headlamp (low-beam projector type headlamp) utilizing an HID bulb (metal halide discharge light) as a light source.

The LED light source 30 of the present exemplary embodiment utilized a light source having average values of x=0.3179 and y=0.3255 (corresponding that having a color temperature of 6248K) though the actual chromaticity characteristics may slightly vary at various light emitting points. On the other hand, the comparative headlamp utilized an HID light source having average values of x=0.3362 and y=0.3509 (corresponding that having a color temperature of 5346K).

Although the chromaticity of the LED light source 30 of the present exemplary embodiment was different from that of the HID light source of the comparative headlamp, and accordingly the chromaticity of illumination light was different from each other, they satisfied the requirement of the statutory standard chromaticity range as determined as white illumination light.

In FIG. 6, the listed intensity (unit: cd) was measured at the measured points L0 to L6 within the range of 0 to 30 degrees in the left direction in the light distribution pattern, and the listed values were relative value (%) with respect to the maximum intensity among these measured points L0 to L6. As shown, the vehicle light 1 of the present exemplary embodiment shows the intensities (within the above range) of 20% or more with respect to the maximum intensity value at the measured point L1 (at 5 degrees leftward) whereas the comparative headlamp shows the intensities of 3.6% at the measured point L6. This shows the inventive vehicle light can illuminate brighter and wider than the comparative headlamp. Not shown in FIG. 6, the vehicle light 1 of the present exemplary embodiment could show the intensity of approx. 500 cd at the 65 degrees point leftward.

As to the chromaticity, FIGS. 7 and 8 show the comparison between the vehicle light 1 of the present exemplary embodiment and the comparative headlamp at the respective measured points L0 to L6 on the chromaticity diagram. As shown, the variation in chromaticity of illumination light of the vehicle light 1 of the present exemplary embodiment is smaller than that of the comparative headlamp. In terms of the numerical values of the chromaticity x and y, the difference between the maximum value and the minimum value (variation) at from the measured point L0 (H=0 degrees) to the measured point L6 (H=60 degrees) is $\Delta x=0.009$ (approx. 0.01) and $\Delta y=0.017$ (approx. 0.02) for the vehicle lamp 1 of the present exemplary embodiment whereas $\Delta x=0.025$ and $\Delta y=0.032$ for the comparative headlamp.

As being clear from the above differences, the vehicle light 1 of the present exemplary embodiment can form a light distribution pattern with less color shading within a sufficiently small variation range from the 0-degree point (in front of the vehicle body) to the 30-degree point (left-side pedestrian way).

It should be noted that the chromaticity variation may depend on the individual specificity, but the chromaticity variation of the vehicle light 1 of the present exemplary embodiment can be controlled between the measured point L4 (20 degrees leftward) and the measured point L0 (0 degrees) within the ranges of $\Delta x \leq 0.002$ and $\Delta y \leq 0.02$. Accordingly, the chromaticity variation within this range between 0 degrees and 20 degrees leftward may be sufficient for actual use.

Further, the chromaticity variation of the vehicle light 1 of the present exemplary embodiment can be controlled between the measured point L6 (30 degrees leftward) and the measured point L0 (0 degrees) within the ranges of $\Delta x \leq 0.001$ and $\Delta y \leq 0.03$. At the same time, the chromaticity variation of the vehicle light 1 can be controlled between the measured point L2 (10 degrees leftward) and the measured point L0 (0 degrees) within the ranges of $\Delta x \leq 0.01$ and $\Delta y \leq 0.02$.

FIG. 7 also shows the black body locus, the isotemperature line, and the isanomal. The chromaticity (color correlated temperature) of the vehicle light 1 of the present exemplary embodiment can be controlled to the range of 5000 K or more (and possibly 7000 K or less) within the white chromaticity range W. On the contrary thereto, the chromaticity of the comparative headlamp is approx. 5000 K or less (and 4000 K or more). Accordingly, the vehicle light 1 of the present exemplary embodiment can emit white light closer to the bluish range than the case of the comparative headlamp. This difference may be caused by the difference of the chromaticity of the light source. It is determined that, since the vehicle light 1 of the present exemplary embodiment can emit illumination light with the chromaticity, or correlated color temperature of 5000 K or more, colors of an object can be discriminated easier than the comparative headlamp, meaning that the vehicle light 1 can be superior in color rendering properties.

A description will now be given of another exemplary configuration of the light source units 2A to 2D of the vehicle light 1 of FIG. 2, illustrating the embodiment that can prevent the occurrence of the color blurring (generation of unintended color separated illumination area Q) near the bright-dark boundary line CL.

Figure 12A:
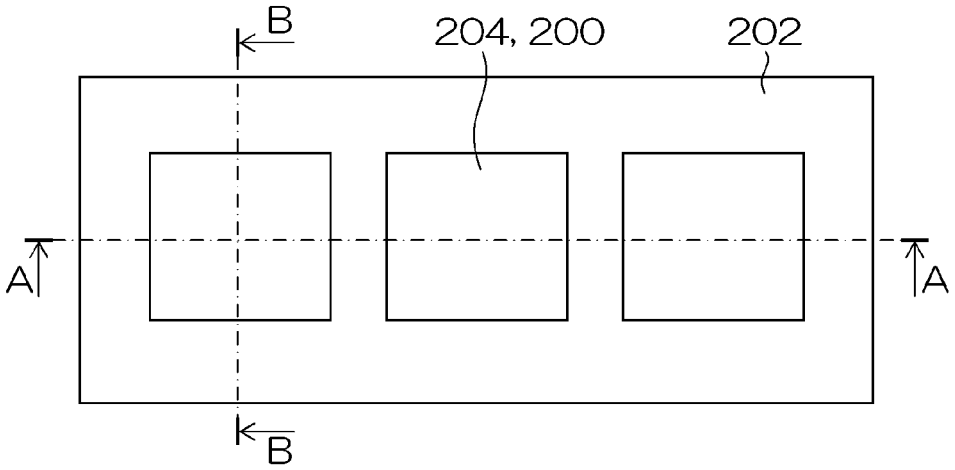
FIGS. 12A, 12B and 12C are a plan view, a cross sectional view taken along line B-B of FIG. 12A, and a cross sectional view taken along line A-A of FIG. 12A of the exemplary configuration of an LED light source, respectively.
Figure 12B:
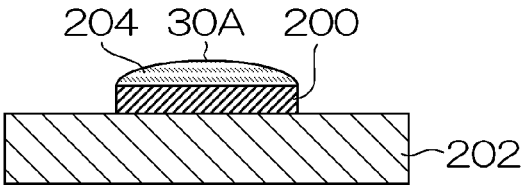
Figure 12C:
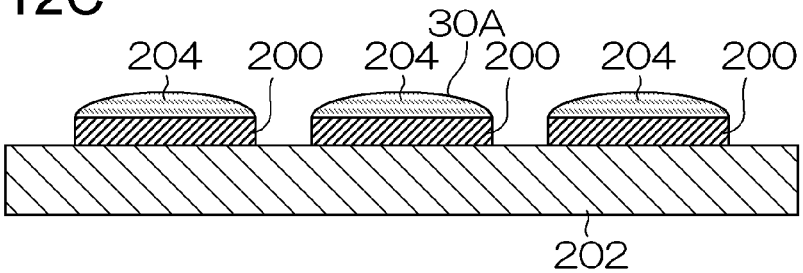

Specifically, the LED light source 30 with a different packaging configuration will be described. FIGS. 12A to 12C illustrate a package using the same LED chip as in those illustrated in FIGS. 11A to 11C. FIG. 12A is a plan view of the LED chip package, FIG. 12B is a cross sectional view taken along line B-B of FIG. 12A, and FIG. 12C is a cross sectional view taken along line A-A of FIG. 12A.

In FIGS. 12A to 12C, three InGaN-based LED chips 200 (the same as those used in FIGS. 11A to 11C) are arranged in line at predetermined intervals, and wavelength conversion layers 204 can cover the respective top surfaces of the LED chips 200. The wavelength conversion layer 204 can be provided not at the side areas, but only on the top surface of the LED chip 200 in a convex shape. In order to form the wavelength conversion layer in a convex shape, a liquid light-transmitting resin material containing a wavelength conversion material dispersed therein can be used to be dropped on the top surface by dispensing method or the like, followed by the curing with the shape maintained by the surface tension.

In the previous exemplary embodiment, a description was given of the case where the LED light source 30 of FIGS. 11A to 11C was used. When another vehicle light utilizing the LED light source of FIGS. 12A to 12C instead of that of FIGS. 11A to 11C was used, almost the same results were obtained as in the case of the LED light source 30 of FIGS. 11A to 11C in terms of the color temperature and chromaticity. As in the previous exemplary embodiment, this vehicle light could suppress the color shading of the illumination light.

The LED light source of FIGS. 12A to 12C may vary in its properties due to the variation in wavelength conversion layer thickness, concentration, position, and the like during its manufacturing processes, as in the case of FIGS. 11A to 11C. In addition, the LED chips may vary in emission intensity, and accordingly, the LED light source 30 having such an LED chip may vary in emission intensity. Even if the LED light source emits light with color shading, the presently disclosed subject matter can reduce the color shading of the illumination light by overlaying light beams from various light emitting points in the above-described manner.

Figure 9:
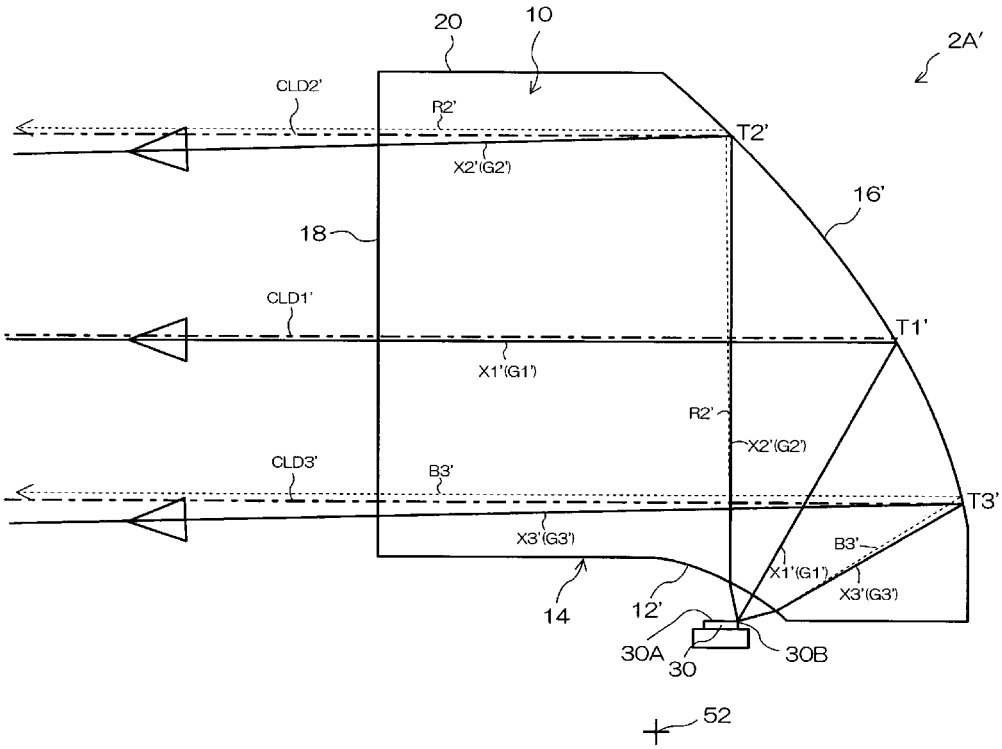
FIG. 9 is a vertical cross sectional view illustrating a vehicle light according to another exemplary embodiment of the presently disclosed subject matter.

FIG. 9 is a vertical cross sectional view illustrating a second exemplary embodiment of the configuration of a light source unit 2A. In the drawing, the same or similar components as or to those of the light source unit 2A of the first exemplary embodiment in FIG. 3 are denoted by the same reference numeral or that with prime (').The light source unit 2A of FIG. 9 has a different light incident surface 12' from that of the light source unit 2A of FIG. 3. The light incident surface 12' can be formed not by a flat plane, but by a concave surface. The other components can be composed as in the first exemplary embodiment, so that the light distribution sub-pattern PA of FIG. 4 can be formed by the reflecting surface 16' of the lens body 10 of FIG. 9.

For example, the light incident surface 12' can be formed by a circular arc with a center 52 away from the light emitting point 30B of the LED light source 30 (here, the circular arc has a larger radius of curvature than a circular arc that is formed by the light emitting point 30B as a center). The center 52 of the circular arc can be set by connecting the light emitting point 30B and the position T1' of the reflecting surface 16' near its center. Accordingly, the incident angle at the light incident surface 12' can be smaller than the case of the light source unit 2A of the first exemplary embodiment, thereby suppressing the chromatic dispersion at the light incident surface 12' due to refraction more than the first exemplary embodiment.

The shape of the reflecting surface 16' can be designed by taking the chromatic dispersion occurring in the lens body 10 into consideration. The white light beams X1' among white light beams emitted from the light emitting point 30B in various directions can perpendicularly enter the light incident surface 12' and cannot be subjected to refraction at the light incident surface 12' and the light exiting surface 18. The target projection direction is the angular direction to the bright-dark boundary line CL. Accordingly, the shape (position and inclination) of the reflecting surface 16' at the position T1' can be formed so as to reflect the white light beams X1' (or green light beams G1') to the bright-dark boundary line CL along the optical path CLD1'.

On the other hand, the white light beams X2' and X3' can be subjected to refraction at the light incident surface 12' due to certain incident angles with respect to the light incident surface 12', and accordingly, the angular directions can be set lower than the target bright-dark boundary line CL depending on the magnitude of the chromaticity dispersion (color separation) due to the refraction. In this case, a constant standard refractive index is considered over the entire range of wavelengths of white light beams, and the shape of the reflecting surface 16' can be designed so that the white light beams X2' and X3' (or green light beams G2' and G3') can be directed (reflected) to respective angular directions lower than the angular directions to the bright-dark boundary line CL (optical paths CLD2' and CLD3').

By this configuration, the chromatic dispersion at the light incident surface 12' can be suppressed more than in the first exemplary embodiment. Accordingly, the color blurring above the bright-dark boundary line CL can be suppressed more, or alternatively, the generation of color blurring can be completely prevented. Taking this feature into consideration, the angular direction of the white light beams (green light beams) can be made smaller, resulting in less change in the shape of the reflecting surface 16'. This means the adverse affect for the light distribution provided by other illumination area than the bright-dark boundary line CL can be suppressed.

It should be noted that the light incident surface 12' may be an elliptic arc as long as it has a concave surface when viewed from the light emitting point 30B to obtain the same advantageous effects. When the light incident surface 12' is formed to have a spherical surface with the center of the light emitting point 30B, the light incident angle can be 0 degrees without refraction, meaning that the color separation cannot be occur with any incident angle. However, in this case, the light utilization efficiency can be maintained only when the reflecting surface is designed to be large enough to cover the light entering the spherical light incident surface. Accordingly, the lens body can be larger than the previous exemplary embodiments. In view of this, the convex curved surface may be the best choice in a well balanced manner between the light utilization efficiency and the entire size of the lens body. Furthermore, the radius of curvature of the light incident surface near the reflecting surface can be designed to be closer to the radius of curvature of a spherical surface with the center of the light emitting point 30B.

Figure 10:
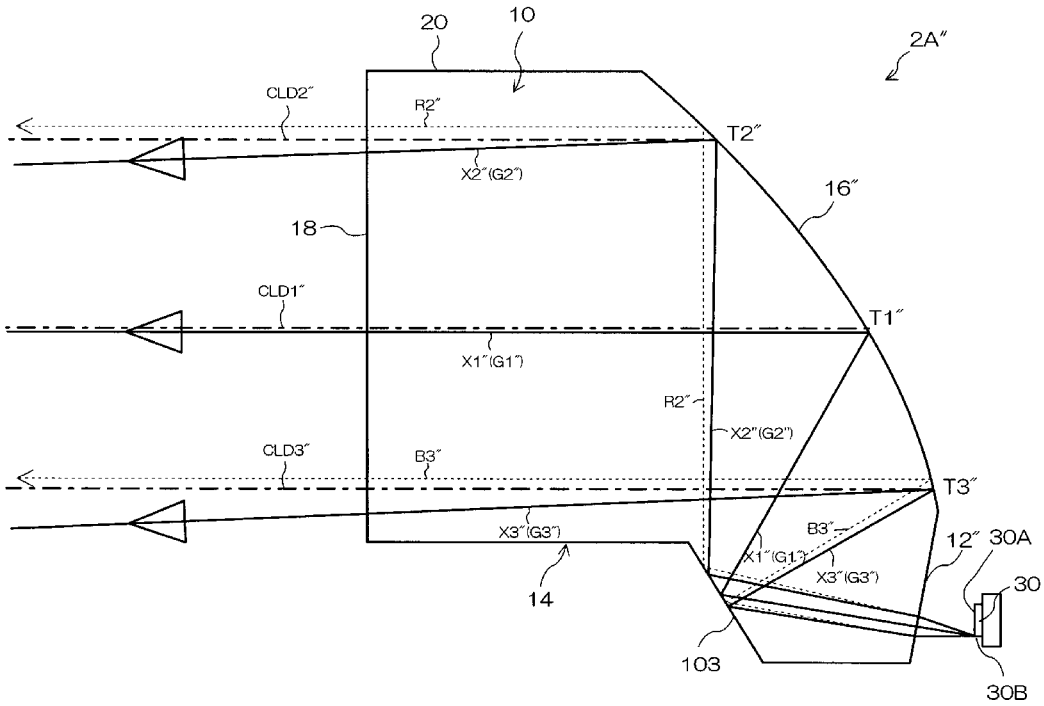
FIG. 10 is a vertical cross sectional view illustrating a vehicle light according to yet another exemplary embodiment of the presently disclosed subject matter.

FIG. 10 is a vertical cross sectional view illustrating a third exemplary embodiment of the configuration of a light source unit 2A. In the drawing, the same or similar components as or to those of the light source unit 2A of the first exemplary embodiment in FIG. 3 are denoted by the same reference numeral or that with double-prime (''). When compared with the light source unit 2A of FIG. 3, the light source unit 2A of FIG. 10 can have a different configuration that guides the light beams emitted from the LED light source 30 to the reflecting surface 16''. In this exemplary embodiment, the light incident surface 12'' can be formed on the rear side of the lens body 10 (near the rear side of the vehicle body) and the LED light source 30 can be disposed on the rear side of the lens body 10 with the light emitting surface 30A facing the front side of the vehicle body.

In this configuration, the light beams that are emitted from the LED light source 30 and enter the lens body 10 through light incident surface 12'' can be directed to the reflecting surface 16'' not directly, but via another reflecting surface 103. Namely, the light beams entering the lens body 10 can be projected through the light exiting surface 18 with two times reflection within the lens body 10. In the illustrated example, the reflecting surface 103 can be formed by depositing aluminum on an outer surface of the lens body 10 where to form the reflecting surface 103.

The light source unit 2A of this configuration shown in FIG. 10 can prevent the occurrence of color blurring above the bright-dark boundary line CL as in the case of light source unit 2A of the first exemplary embodiment.

The shape of the reflecting surface 16'' can be designed by taking the chromatic dispersion occurring in the lens body 10 into consideration. The white light beams X1'' among white light beams emitted from the light emitting point 30B in various directions can perpendicularly enter the light incident surface 12'' and cannot be subjected to refraction at the light incident surface 12'' and the light exiting surface 18. The target projection direction is the angular direction to the bright-dark boundary line CL. Accordingly, the shape (position and inclination) of the reflecting surface 16'' at the position T1'' can be formed so as to reflect the white light beams X1'' (or green light beams G1'') to the bright-dark boundary line CL along the optical path CLD1''.

On the other hand, the white light beams X2'' and X3'' can be subjected to refraction at the light incident surface 12'' due to certain incident angles with respect to the light incident surface 12'', and accordingly, the angular directions can be set lower than the target bright-dark boundary line CL depending on the magnitude of the chromaticity dispersion (color separation) due to the refraction. In this case, a constant standard refractive index is considered over the entire range of wavelengths of white light beams, and the shape of the reflecting surface 16'' can be designed so that the white light beams X2'' and X3'' (or green light beams G2'' and G3'') can be directed (reflected) to respective angular directions lower than the angular directions to the bright-dark boundary line CL (optical paths CLD2'' and CLD3'').

The light source unit 2A of the third exemplary embodiment can widen the selection degree of freedom for disposing the LED light source 30 with the plural reflecting surfaces (16'' and 103) for guiding the light beams within the lens body 10. Namely, the change of the positions of the light incident surface 12'' and the reflecting surface 103 can alter the position of the LED light source 30. Also in this case, the projection direction of green light beams travelling through a refractive optical path can be set to lower than the angular direction of the bright-dark boundary line CL by the specific shape of the reflecting surface 16'', thereby preventing the color blurring from being generated above the bright-dark boundary line CL.

It should be noted the number of reflection in the lens body is not limited to two, but may be three or more as long as the reflecting surface 16 can be formed to prevent the color blurring from being generated above the bright-dark boundary line CL.

As in the first exemplary embodiment, the second and third exemplary embodiments can prevent the generation of color shading near the boundary areas at left, right, and lower edges of the light distribution sub-pattern as in the first exemplary embodiment.

In the first to third exemplary embodiments, the non-refractive optical path through which light beams can travel without refraction is provided at approximate vertical center in the reflecting surface 16 (16' and 16''), but the presently disclosed subject matter is not limited to this. For example, the non-refractive optical path can be disposed near the upper most portion or lowermost portion of the reflecting surface 16 (16' and 16'').

In the first to third exemplary embodiments, the shape of the reflecting surface 16 (16' and 16'') can be corrected from its basic shape, but the presently disclosed subject matter is not limited to this. Any action surface, namely, at least one surface selected from the group consisting of the light incident surface 12 (12' and 12''), the reflecting surface 16 (16' and 16''), and the light exiting surface 18 (18') can be corrected from its basic shape.

In the first to third exemplary embodiments, the basic configuration of the lens body 10 can be set to enlarge and project the light emitting surface 30A of the LED light source 30, but the presently disclosed subject matter is not limited to this. For example, the basic configuration of the lens body 10 in the light source unit 2A of the first exemplary embodiment of FIG. 3 can be designed such that: white light beams from the same light emitting point of the LED light source 30 in various directions can be dispersed in a wider illumination area; and such that white light beams emitted from separate light emitting points can be mixed with each other to be overlaid from each other. By doing so, even when the color separation occurs in white light beam passing through a refractive optical path, not the color separated light beams in a similar mode, but the light beams color separated in various manners from respective optical paths can be mixed together. Accordingly, the color shading of the illumination light can be suppressed more effectively (the color shading includes that due to the color shading of the LED light source 30), resulting in the decrease of the correction amount from the basic shape.

In this case, the basic shape of the lens body 10 may be such that the white light beams emitted from the rearmost end light emitting point 30B of the LED light source 30 can be directed to the bright-dark boundary line CL while the white light beams emitted from the foremost end light emitting point of the LED light source 30 can be directed to the lower edge of the light distribution sub-pattern PA. The basic shape of the lens body 10 can be designed such that the white light beams emitted from the foremost end light emitting point of the LED light source 30 may also be directed to the areas other than the lower edge of the light distribution sub-pattern PA with the areas needing to be brighter (near the upper edge).

In alternative exemplary embodiment, the reflecting surface and the like of the lens body 10 can be formed of a plurality of divided reflection areas including those for directing and spreading white light beams in a horizontal direction (vertically narrow areas) and those for directing and spreading white light beams in a vertical direction (horizontally narrow areas) wherein these areas are disposed in a zigzag fashion. In this manner, the white light beams from the nearby light emitting points can be projected to different areas and/or the white light beams from the separated light emitting points can be projected to the same areas. Accordingly, a plurality of light source units can form a single light distribution pattern by controlling the light distribution within a single light source unit or in conjunction with other light source units.

The light source unit of the first to third exemplary embodiments can have a lens body formed of polycarbonate or other material including glass, acrylic resin, and the like. Even when a material that generate chromatic dispersion is employed, the presently disclosed subject matter can be applied to these cases.

In the light source unit of the first to third exemplary embodiments, the polycarbonate material is used. In this case, the birefringence of the polycarbonate material may generate blurring of the bright-dark boundary. However, the presently disclosed subject matter can not only prevent the color shading of illumination light, but also reduce such blurring of the bright-dark boundary due to birefringence of the polycarbonate material. For example, when using polycarbonate material, a residual stress is large after molding, and the molded article may have a birefringence due to the photoelasticity of the material. The birefringence may affect the light beams entering the light incident surface 12 (12' and 12") obliquely, so that the light beams may be separated in a plurality of directions. When ignoring this birefringence and considering the simple designing with a constant standard refractive index, the light beams separated due to the birefringence can generate blurring of the bright-dark boundary. Even in this case, the specific design in which the light beams color separated as in the previous exemplary embodiments can be directed in certain angular directions within the light distribution pattern below the bright-dark boundary line. This can also suppress the blurring due to the birefringence.

In the first to third exemplary embodiments, the shape of the light exiting surface 18 is a flat plane and light beams reflected from the reflecting surface 16 (16' and 16") are not subject to refraction by the light exiting surface 18. However, even if the basic shape of the light exiting surface 18 is not a flat plane and light beams are subjected to refraction by the light exiting surface 18, the presently disclosed subject matter can be applied to obtain the specific advantageous effects.

Namely, any one of light incident surface, reflecting surface and light exiting surface can be formed to correct light beams having been color separated through the refractive optical path at any of the light incident surface and the light exiting surface so that the corrected light beams can be overlaid with other light beams within the desired light distribution pattern.

The vehicle light of the presently disclosed subject matter is not only applicable for use with a low beam headlamp, but also a high beam headlamp, a fog lamp, a signal lamp, and other various vehicle lights.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle light comprising:

a light emitting diode light source configured to emit visible light at a plurality of wavelengths, the light emitting diode light source having a light emitting surface at an edge of which color shading occurs; and a lens body having a light incident surface, a reflecting surface, and a light exiting surface, and configured such that light beams from the light emitting diode light source enter the lens body through the light incident surface and are reflected by the reflecting surface in a predetermined direction to exit from the lens body through the light exiting surface so that an image of the light emitting surface of the light emitting diode light source is enlarged and projected by the lens body and the light beams exiting from the lens body form illumination light with a predetermined light distribution pattern, wherein the reflecting surface is formed so that light beams emitted from the edge of the light emitting diode light source exits through the light exiting surface of the lens body so as to be directed while spread to a boundary and an inner area of the light distribution pattern, and the light beams emitted from the edge of the light emitting diode light source is overlaid over light beams emitted from an area other than the edge of the light emitting face of the light emitting diode light source, the lens body has a refractive optical path configured to direct the light beams emitted from the edge of the light emitting diode light source towards the boundary of the light distribution pattern and refract the light beams by at least one of the light incident surface and the light exiting surface; and the reflecting surface includes a refractive optical path reflecting portion configured to reflect the light beams passing through the refractive optical path, the refractive optical path reflecting portion configured such that light beams that have passed through the refractive optical path and subjected to color separation at all wavelengths exits from the lens body through the light exiting surface towards the boundary of or within the light distribution pattern, the light beams emitted from the edge of the light emitting diode light source exits from the light exiting surface of the lens body so as to be spread in a direction of the boundary or inner area of the light distribution pattern by the refractive optical path reflecting portion.

2. The vehicle light according to claim 1, wherein the light source and the lens body constitute a light source unit, and the vehicle light includes a plurality of the light source units, and each of the light source units has a different light distribution pattern, and the different light distribution patterns from the plurality of the light source units are overlaid with each other to form a required light distribution pattern for the vehicle light, thereby illuminating a pedestrian's side road with a wide range.

3. The vehicle light according to claim 2, wherein the light emitting diode light source includes a light emitting diode and a wavelength conversion material.

4. The vehicle light according to claim 1, wherein the light emitting diode light source includes a light emitting diode and a wavelength conversion material.

5. A vehicle light comprising:

an light emitting diode light source configured to emit visible light at a plurality of wavelengths, the light emitting diode light source having a light emitting surface at an edge of which color shading occurs; and a lens body having a light incident surface, a reflecting surface, and a light exiting surface, and configured such that light beams from the light emitting diode light source enter the lens body through the light incident surface and are reflected by the reflecting surface in a predetermined direction to exit from the lens body through the light exiting surface so that an image of the light emitting surface of the light emitting diode light source is enlarged and projected by the lens body and the light beams exiting from the lens body form illumination light with a predetermined light distribution pattern, wherein the reflecting surface is formed so that light beams emitted from the edge of the light emitting diode light source exits through the light exiting surface of the lens body so as to be directed while spread to a boundary and an inner area of the light distribution pattern, and the light beams emitted from the edge of the light emitting diode light source is overlaid over light beams emitted from an area other than the edge of the light emitting face of the light emitting diode light source, and the reflecting surface is configured such that light beams emitted from the edge of the light emitting diode light source are reflected at a first angle with respect to the reflecting surface, and the light beams emitted from an area other than the edge of the light emitting face of the light emitting diode light source are reflected at a second angle with respect to the reflecting surface different than the first angle.

6. A vehicle light comprising:

a light emitting diode light source configured to emit visible light at a plurality of wavelengths, the light emitting diode light source having a light emitting surface at an edge of which color shading occurs; and a lens body having a light incident surface, a reflecting surface, and a light exiting surface, and configured such that light beams from the light emitting diode light source enter the lens body through the light incident surface and are reflected by the reflecting surface in a predetermined direction to exit from the lens body through the light exiting surface so that an image of the light emitting surface of the light emitting diode light source is projected by the lens body and the light beams exiting from the lens body form illumination light with a predetermined light distribution pattern, wherein the lens body has a refractive optical path which is configured to direct light beams emitted from the edge of the light emitting diode light source towards a boundary of the light distribution pattern and refract the light beams by at least one of the light incident surface and the light exiting surface, and at least one of the light incident surface, the reflecting surface and the light exiting surface is configured to correct light beams having been color separated through the refractive optical path at at least one of the light incident surface and the light exiting surface so that the corrected light beams are overlaid with other light beams within the predetermined light distribution pattern.

7. The vehicle light according to claim 6, wherein:

the reflecting surface includes a refractive optical path reflecting portion configured to reflect the light beams passing through the refractive optical path, the refractive optical path reflecting portion being formed such that light beams that have passed through the refractive optical path to be subjected to color separation at all wavelengths exits from the lens body through the light exiting surface towards the boundary of or within the light distribution pattern, the light beams emitted from the edge of the light emitting diode light source exits from the light exiting surface of the lens body so as to be spread in a direction of the boundary or inner area of the light distribution pattern by the refractive optical path reflecting portion.

8. The vehicle light according to claim 7, wherein the light source and the lens body constitute a light source unit, and the vehicle light includes a plurality of the light source units, and each of the light source units has a different light distribution pattern, and the different light distribution patterns from the plurality of the light source units are overlaid with each other to form a required light distribution pattern for the vehicle light, thereby illuminating a pedestrian's side road with a wide range.

9. The vehicle light according to claim 7, wherein the light emitting diode light source includes a light emitting diode and a wavelength conversion material.

10. The vehicle light according to claim 6, wherein the light source and the lens body constitute a light source unit, and the vehicle light includes a plurality of the light source units, and each of the light source units has a different light distribution pattern, and the different light distribution patterns from the plurality of the light source units are overlaid with each other to form a required light distribution pattern for the vehicle light, thereby illuminating a pedestrian's side road with a wide range.

11. The vehicle light according to claim 6, wherein the light emitting diode light source includes a light emitting diode and a wavelength conversion material.

* * * * *